US010748513B2

(12) United States Patent
Giger et al.

(10) Patent No.: US 10,748,513 B2
(45) Date of Patent: Aug. 18, 2020

(54) GUITAR HAVING FRETBOARD CONSISTING OF HIGH-DENSITY BAMBOO

(71) Applicant: RELISH BROTHERS AG, Sempach Station (CH)

(72) Inventors: Pirmin Giger, Neuenkirch (CH); Silvan Küng, Kehrsiten (CH); Marco Keller, Baden (CH)

(73) Assignee: RELISH BROTHERS AG, Sempach Station (CH)

( * ) Notice: Subject to any disclaimer, the term of this patent is extended or adjusted under 35 U.S.C. 154(b) by 0 days.

(21) Appl. No.: 16/474,729

(22) PCT Filed: Dec. 29, 2017

(86) PCT No.: PCT/EP2017/084810
§ 371 (c)(1),
(2) Date: Jun. 28, 2019

(87) PCT Pub. No.: WO2018/122374
PCT Pub. Date: Jul. 5, 2018

(65) Prior Publication Data

US 2019/0333483 A1 Oct. 31, 2019

(30) Foreign Application Priority Data

Dec. 29, 2016 (CH) ..... 1758/16

(51) Int. Cl.
*G10D 3/06* (2020.01)
*G10D 1/08* (2006.01)
*G10D 3/22* (2020.01)

(52) U.S. Cl.
CPC ..... *G10D 3/06* (2013.01); *G10D 1/085* (2013.01); *G10D 3/22* (2020.02)

(58) Field of Classification Search
CPC ..... G10D 3/06; G10D 1/005; G10D 1/085
See application file for complete search history.

(56) References Cited

U.S. PATENT DOCUMENTS 4,122,745 A 10/1978 Darias Paya
4,184,404 A 1/1980 Tomioka
(Continued)

FOREIGN PATENT DOCUMENTS

CN 103258525 A 8/2013
EP 1020842 A2 7/2000
(Continued)

OTHER PUBLICATIONS

International Search Report; PCT Application No. PCT/EP2017/084810; dated Jul. 5, 2018.
(Continued)

*Primary Examiner* — Kimberly R Lockett
(74) *Attorney, Agent, or Firm* — Polsinelli PC

(57) ABSTRACT

A guitar is provided which has a guitar neck. At least the fretboard of the neck is made of a high-density bamboo, that is, a compressed grass, instead of a wood. The guitar may be an electric guitar. In an alternative, the entire neck can also be made of high-density bamboo. The high-density bamboo is planed from compressed raw strips horizontally or vertically glued together and pressed to form high-density bamboo, known as HDG bamboo or strand woven bamboo. The frets on the fretboard are inserted into milled grooves in the fretboard in the usual manner. The curvature between the guitar neck and the guitar head can be produced by bending a single-piece wooden workpiece after steaming so that the wood fibres running along the guitar neck run continuously into the guitar head.

7 Claims, 1 Drawing Sheet

(56) References Cited

U.S. PATENT DOCUMENTS

Figure 1:
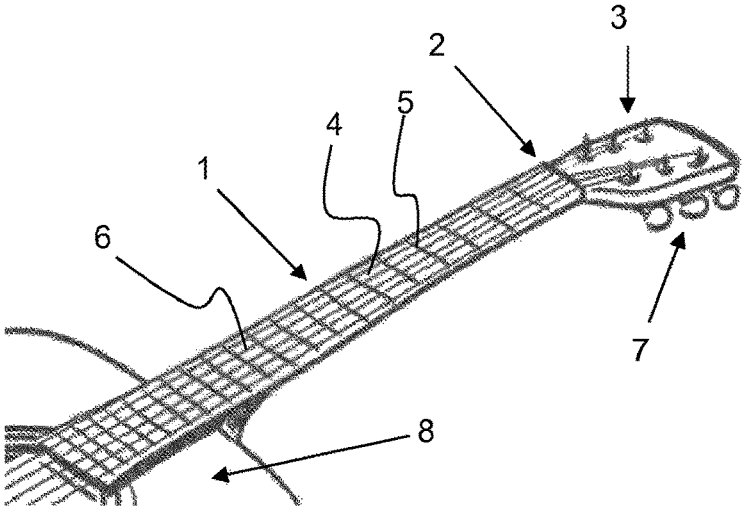

| | | | | |
|---|---|---|---|---|
| 6,051,764 | A * | 4/2000 | Sakurai | G10D 1/005 84/290 |
| 6,087,568 | A | 7/2000 | Seal | |
| 2011/0027529 | A1 * | 2/2011 | Zhang | B27N 3/04 428/137 |

FOREIGN PATENT DOCUMENTS

| | | | |
|---|---|---|---|
| JP | 2008145873 | A | 6/2008 |
| JP | 4414483 | B1 | 2/2010 |
| WO | 2018122374 | A1 | 7/2018 |

OTHER PUBLICATIONS

English Translation of International Search Report; PCT Application No. PCT/EP2017/084810; dated Jul. 5, 2018.
Written Opinion of PCT Application No. PCT/EP2017/084810; dated Jul. 5, 2018.
English Language Abstract of JP4414483; Retreived From www.espacenet.com on Jun. 7, 2019.
English Language Abstract of CN103258525; Retreived From www.espacenet.com on Jun. 7, 2019.
English Language Abstract of JP200814587; Retreived From www.espacenet.com on Jun. 7, 2019.

* cited by examiner

GUITAR HAVING FRETBOARD CONSISTING OF HIGH-DENSITY BAMBOO

CROSS-REFERENCE TO RELATED APPLICATIONS

This application is a national stage entry of PCT/EP2017/084810 filed Dec. 29, 2017, which claims priority to Swiss patent application 01758/16 filed on Dec. 29, 2016, the contents of each are hereby incorporated by reference in their entirety.

A solid-body guitar consists of a board which can have an almost arbitrary contour. Screwed onto this is the bridge, over which the strings run. A tailpiece which can also be integrated into the bridge is additionally present. The neck is screwed onto this board, the body (e.g. Stratocaster) or is glued into this board (e.g. Les Paul), over which neck the stings are tensioned between the nut on the head and the bridge on the body in an ordered manner according to the string gauge.

With regard to today's guitars, the neck does not mostly consist of one piece, but comprises a glued-on fretboard, over which the strings run. This design on the one hand has advantages with regard to the stability of the neck and on the other hand the selection of the woods for the neck and fretboard has a significant influence on the sound and the playability of the guitar.

With regard to classic guitars with gut strings or plastic strings, a simple solid wooden neck has a sufficient stability, in order to withstand the tension of the strings without any annoying deformation. Many instruments with steel strings, above all Western or Steel guitars and guitars, as well as very particularly electrical base guitars however yet have an adjustable truss or trussrod which is recessed into the neck. This trussrod lies roughly in the middle of the neck in an arcuate channel and effects a pretensioning of the neck counter to the tension of the strings. Typically guitars are provided with frets on the fretboard. These help in shortening the string in a very precise manner on gripping, in order to produce a certain tone on being struck. Herein, each fretrod generally corresponds to a semitone step. The frets originally consisted of gut and were then later manufactured of ivory or silver. Modern guitars frets are mostly manufactured of nickel silver. Frets of solid material are immovably recessed into the fretboard. Strictly speaking, this construction manner does not allow the production of nuances. However, this is also possible by way of suitable play techniques such as for example bending, bottle neck (or slide).

The neck varies depending on the type of guitar. Classical guitars tend to have a wide and flatly arcuate neck, steel string guitars a narrow and almost semi-round necks as well as arcuate fretboards. The nut is located at the end of the fretboard. Nuts of plastic and of bone are most widespread. They are either recessed into a groove which is milled into the fretboard or are glued onto the end of the fretboard. Plastic nuts are industrially manufactured and are therefore less expensive. Concerning bone nuts, one differentiates between two different materials: between boiled and almost white, bleached bone nuts and so-called fat nuts which consist of non-boiled unbleached cattle bone. Due to the fat share which remains in the bone, the latter ensure a lubrication in the nut notches, which renders it more difficult for the strings to jam. Fat nuts have a slight yellow colouring due to their naturalness. Various plastic graphite mixtures are also used for the manufacture of guitar nuts due to their easy machining and processing ability and lubricative properties.

With some guitars, the neck is also continuous, which is to say either completely goes through the body or more seldom it only reaches up to the bridge, by way of which one desires a long duration of the tone (sustain). This may be the case in comparison to early, less professional screwed-in necks, but when compared to a neck which is correctly glued in with craftsmanship, at least in theory with otherwise the same constrains, no difference is to be expected, since a good bonding location has a greater strength and an a lower damping than wood. Moreover, today's quality of the screwing gives no reason for criticism with regard to the worsening of the sustain. However, since at first appearance it sounds plausible, guitars with a continuous neck have been sold for more money than those with a screwed or glued-in neck. Nowadays, guitars with a continuous neck have become more seldom. Such is more likewise to be found with base guitars. Concerning electrical guitars, mostly one to three pickups are attached between the bridge and the neck, either fastened on a pickguard (e.g. Stratocaster) which simultaneously serves as a beat board, or however is assembled from the front directly on the wood (e.g. Les Paul).

Rosewood for example or tropical woods are selected for the fretboard, since these woods are particularly hard and can therefore withstand the string pressure when the strings are pressed onto the fingerboard by the fingers of the guitar player. On playing, the strings are not only pressed down onto the fingerboard or fretboard, but the string is also pushed on the finger board to and fro transversely to its running direction amid continued pressing pressure. The fingerboard and thus the wood which is used for this is therefore loaded to a high measure and wears with time. One can then clearly recognise the signs of wear.

The use of tropical woods, irrespective of the application purpose, has generally come under fire since it contributes massively to the clearing of tropical rainforests. For this reason, there is therefore a desire to move towards other woods or materials. Basically, woods however have proven their worth for use as fretboard or guitar necks, particularly due to their feel. They are warm to touch, and even if they are hard to some extent, despite this they feel soft to touch—for instance compared to a steel or aluminium plate which conveys a hard feel.

It is the object of the invention to specify a new material for fretboards of a guitar which is expressly not actually a wood and which is capable of fulfilling particular demands, specifically stability, hardness, a pleasant feel and which is also inexpensive and can be easily worked (processed/machined), as well as is adequately durable and loadable and moreover relatively inexpensive. Further embodiments of the guitar neck, apart from a hard fretboard of non-wood, should also provide a more stable neck.

The object is achieved by a guitar of a body, neck and head, wherein at least the fretboard of the neck consists of high-density bamboo, thus of a compacted grass. In a particular and advantageous embodiment, the guitar neck and the guitar head are manufactured of wood, bent wood layers or bamboo layers, which are pre-treated in steam and then bent.

Figure 2:
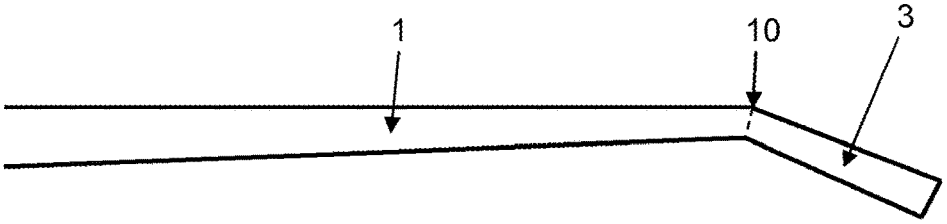
Figure 3:
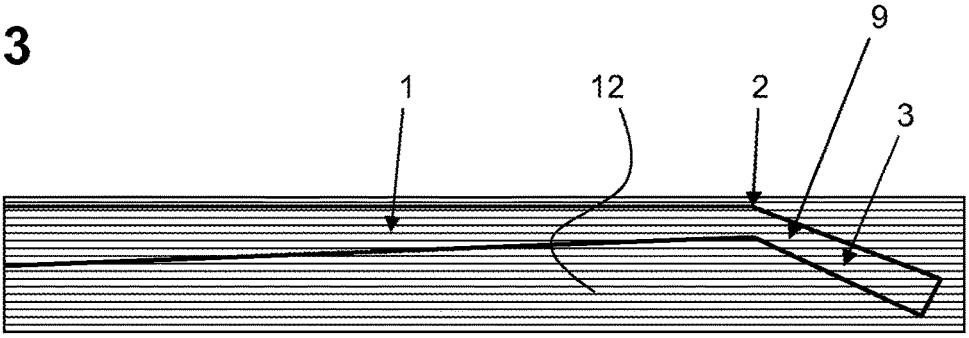
Figure 4:
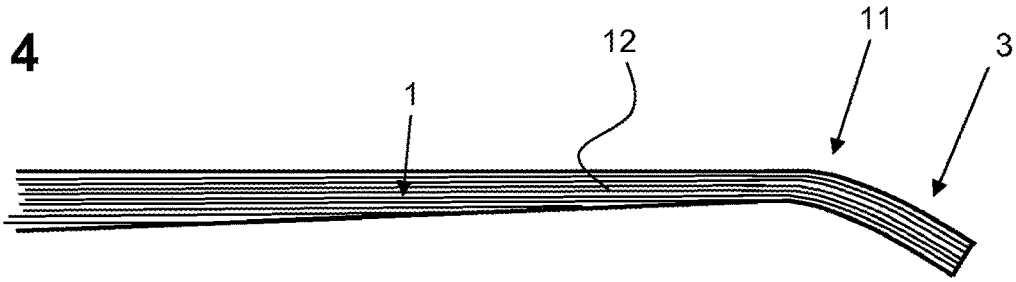

In the figures, a guitar neck with a bamboo fretboard is represented and also the different basic manufacturing methods for a guitar neck are presented and explained. Herein are shown:

FIG. 1 a guitar neck seen from the side and with the head and the different constituents thereon;

FIG. 2 a guitar neck seen from the side, which is manufactured of two glued pieces, for the neck and for the guitar head;

FIG. 3 a guitar neck with a guitar head, seen from the side, which is milled from a wooden block out of a solid piece;

FIG. 4 a guitar neck seen from the side, with a guitar head, which is permanently arcuate in its shape by way of hot steam, whereupon a bamboo layer has been glued on as a fretboard.

As is previously known, bamboo has ideal characteristics for use in the fields of building technology. Concerning the discussion regarding ecological construction materials which at the same time meet the high technical specifications in the building trade, there is no getting around the use of bamboo. The fact that a giant grass, whose ratio of intrinsic weight to useable load exceeds even that of steel concrete and whose tensile strength even reaches two and a half times that of steel, is somewhat extraordinary. Even if one compares bamboo to wood, this on average is more superior. On the one hand, due to the extremely dense and fine-pored cell structure it has a very high surface hardness. At 4.0 HB Brinell hardness it is lies significantly above the hardness of for example oak wood which can only provide a hardness of about 3.4 Brinell. Peak values of up to 6.1 Brinell were measured, and this comes close to the hardness of concrete surfaces. One the other hand, its shrinkage and swelling behaviour is significantly lower than most woods. Bamboo is highly dimensionally stable and durable. When used as a flooring, the wear resistance of the surface is also important. This corresponds roughly to that of oak or beech. Further advantages are its high bending strength and weight-carrying strength as well as elasticity and herewith, considered as a whole, its loadability. Since bamboo as a grass has no bark, the protective characteristics with regard to UV light are quasi integrated, so that it also has an extraordinary colour stability. And since it contains no resins, tanning oils or oils, it can be worked particularly easily and treated with surface sealing coats.

Despite the knowledge of such characteristics and its use in the building field, until now high-density bamboo has surprisingly never before been used for guitar parts and particularly not for fretboards of guitar necks. The application for this is convincing, since it is a case of a sustainable raw material which is cultivated in ecological forestry. The technical details of bamboo can be specified as follows:

raw density of bamboo: approx. 700 kg/m$^2$
density of fibre bamboo: approx. 1.15 g/cm$^3$ (for comparison: oak: approx. 0.8 g/cm$^3$; pine: approx, 0.5 g/cm$^3$; bangkirai: approx. 0.95 g/cm$^3$)
compressive strength: 71 N/mm$^2$
bending strength: 151 N/mm$^2$
tensile strength: 120 N/mm$^2$
thermal conductivity of bamboo: 0.17 W/(m·K)
humidity share: 7% to 16%
expansion rate given water absorption: 0.90%
expansion rate in boiling water after one hour: ≤5%
modulus of elasticity: 11870 Mpa
fire resistance grade: $B_{fl}$
anti-slip factor dry: 66, wet: 37
UV durability: ΔE*ab: 1.69

Bamboo grows quickly. This giant grass with a typically growth of 20-30 cm per day is often fully grown after a few months. As a rule, one can harvest it after three to six years if it is adequately "wooded". Herewith, bamboo renews itself on average within five years—in contrast to hardwoods which grow over decades. On account of its rapid growth, the enormous production of biomass and the $CO_2$ balance which is herewith compensated for, bamboo is a very environmentally friendly material and at the same time high-quality raw material which in many characteristics is on par with hardwoods and as mentioned, is known as such in the building sector. Herein, bamboo is comparatively inexpensive. In Europe, it is applied above all in interior construction, thus for example for parquet flooring, and here it represents a very valid alternative to the similarly looking, endangered tropical woods such as teak, wenge or mahogany, but also to the native hardwood types. High-density bamboo as a rule is manufactured from highly compressed Mao bamboo from controlled forests in China For this, bamboo as a rule is planed from horizontally or vertically glued and compacted raw strips and pressed into high-density bamboo wood (HDG-bamboo) and is also known as strand woven bamboo.

This strand woven bamboo or China-HGD-bamboo is harder than most wood types and also significantly harder and more durable that known laminated bamboo woods which are delivered in vertical or horizontal embodiments. This hard, compact and tough material provides an attractive and functional solution for floor coverings, wall panelling, decorative objects and accessories. A parquet of HDG-bamboo is particularly hard, pressure-resistance and scratch-proof, shape-stable and is very durable. Two-layer and three-layer ready parquets as well as solid parquet floorboards and wide-plank floorboards of bamboo are known. These floors can be laid or glued in a floating manner and are also obtainable as tongue and groove boards. HDG-bamboo parquet is manufactured as horizontal and vertical lamellae in different colour tones from naturally light across middle wood tones to dark brown, selectively with a shining or matt surface finished surface or one which is oiled.

The horizontal and vertical lamellae of bamboo grass are preferably mixed with a liquid, reddish-brown phenol-formaldehyde resin of the type DZT-5 and are glued and pressed together into a solid building material, wherein the resin comprises 40-60% phenol-formaldehyde polymer, up to 0.3% free formaldehyde and up to 1% phenol. The phenol formaldehyde herein has the following characteristics:

boiling point: approx. 100° C.
density at 30° C.: 1.1-1.3 g/cm$^3$
viscosity at 25° C.: 50 to 200 cps
pH-value at 30° C.: 9.5-10.5
inflammation point above: 93° C.
thermal decomposition: releases toxic smoke gases, containing carbon monoxides, carbon dioxides, formaldehydes and nitrogen oxides Gloves, protective clothing and eye protection must be worn for processing bamboo with phenol-formaldehyde resin of the type DZT-5. Given body contacts, in particular eye contact, one its to rinse with copious amounts of water for 10 minutes and obtain medical aid. The storage is to be effected in sealed vessels at a cool location. The toxicity depends on the share of sodium hydroxides and on the small quantity of free formaldehyde phenol, which are released on processing/working, whereas the solid constituents or polymers can be seen as being harmless. Formaldehydes are seen as being weakly carcinogenic, according to EEC in Class 3 of the carcinogens, and the product is seen as being corrosive due to its pH-value. Bamboo which is treated and pressed with this product, according to TUV SUD Certification and Testing (China) Co., Ltd. Guangzhou Branch, TUV SUD Group, 5F, Communication Building, 163 Pingyun Rd, Huangpu West Ave., Guangzhou 510656 P. R.

China and others, displays the following results: According to the EN 717-1:2004 test methods, the formaldehyde release was merely 0.0001 mg/m$^3$. Placed in water, the treated bamboo swells by a mere 0.2% according to the method EN 317:1993 and a heat flux according to EN ISO 9239-1:2019 of ≥11 Kw/$^{m2}$. The pressed bamboo chars in the case of fire. A density of 1.25 g/cm$^3$ is achieved with a heat treatment of the bamboo with steam for approx. 72 hours and the expansion rate due to the water absorption is 5.396%. A hardness of 8.61 N/mm$^2$ according to EN 1534-2010 is achieved. The highest durability class according to EU standard is herewith reached, so that this bamboo treated is such a manner is also suitable for outdoor applications and lasts for at least 20 years.

Considering all these advantages, it has being found to be a surprisingly ideal material for the manufacture of fretboards of guitar necks, indeed even for the manufacture of complete guitar necks. The high-density bamboo planed from horizontally or vertically glued and compacted raw strips and pressed into high-density bamboo wood can be cut to size, shaped and post-treated as with conventional hardwoods, but as a particularity is not a wood in the strict sense, is $CO_2$ neutral and is still comparatively inexpensive. Its touch is like that of wood and it therefore has a comparable feel, wherein it is still far harder than hardwoods and is therefore excellently suitable as a fretboard material and provides an even better durability, even under highest loads.

A guitar neck 1 with its constituents is shown in FIG. 1. The guitar head 3, on which the tuning mechanism 7 is built, connects at the front to the guitar neck 1 after a transition location called the nut 2. The fretboard 4, here in the form of a bamboo fretboard 4 is glued at the top on the guitar neck 1. Transversely running frets or fretrods 5 are inserted into grooves which are milled into the material of the fretboard 4. Finally, the tensioned strings 6 run over these frets or fretrods 5. The guitar neck 1 is connected, preferably glued to the guitar body 8 at the rear end region of this neck.

FIG. 2 shows a guitar neck, wherein the neck 1 and the guitar head 3 which connects thereto is manufactured of two glued pieces. It is to be understood that a joint or transition arises at the location of the nut 10, said joint always being a weak location irrespective of how the joint is designed or formed, for instance as a multiple tongue and groove connection or cut in oblique surfaces. An increased potential breakage risk exists at this location.

FIG. 3 shows a guitar neck 1 with a guitar head 3 which is milled out of a single-piece wooden block out of solid material. A gluing of parts can herewith be avoided and one obtains a guitar neck 1 with a head 3 of a single-piece continuous part. The disadvantage is the high wooden material requirement, since much cutting waste arises. Furthermore, this manner of design has a potential breakage location, specifically along the course of the fibres 12 at the location 9 in the region of the nut 2. There, the head 3 will break off given too high a tensile load.

This danger of breakage can be remedied by a guitar neck 1 with a guitar head 3 which is either produced from a single-piece wooden board or a wood laminate—or bamboo laminate, by way of steam bending. This is represented in FIG. 4. The fibres 12 of the wood run along the neck 1, and its frontmost region is bent away by way of a bending after a pre-treatment of the wood in steam, so that a bent guitar head 3 arises in a transitionless manner, and the wood fibres 12 run continuously along the curvature and therefore there, which is to say at the location 11 of the transition from the neck 1 to the head 3, have no increased risk of breakage.

The bending of wood is basically known and is explained hereinafter. One uses a closable steam box. The wood board or wood laminate to be bent is inserted into this. The steam box can consist of different materials. It preferably consists of wood, but however can also be a PVC box or even a hose, into which the board to be bent is pressed. The box at one side has a hole, through which steam can flow in and at the opposite side a further hole, through which the steam can flow out again. Best of all, one drills an exit hole so that it faces the floor. In this manner, excess condensed water can also escape out of the box with the steam. The boards to be bent are inserted into the steam box and are exposed to the steam for about an hour per 2.5 cm thickness. This is effected much more quickly given thinner necks.

Sycamore wood, but also other woods can preferably be applied for a guitar neck 1 and guitar head 3. Bamboo, which is to say compacted grass can also be applied as a material, and this can likewise bent after being treated by steam and be constrained into a desired bending which is permanent after drying out. The wooden board or bamboo board which has been softened by the steam can be removed from the steam box and be carefully placed into a press mould, in which it is constrained for bending the guitar head 3 away from the running direction of the guitar neck 1. The workpiece is held in the press mould by way of clamps or restrainers until it has completely dried out or the steam has escaped from the workpiece. The press mould can be provided at the inside with a thin cork layer which results in a supple surface of the bent workpiece. If the guitar neck 1 and guitar head 3 are produced from a wood laminate, which is to say of individual, previously bent wood layers, then best of all one applies a two-component glue of urea formaldehyde, in order to glue the laminate together. Although it lasts a while until this glue had dried, it however holds very well. Epoxides are also very effective, but relatively expensive. Normal wood glue cannot be applied in order to bend wood by way of lamination. Normal wood glue, although drying quite rapidly, however is still very flexible. One applies bent wood layers, layered onto one another, into the press mould until a later laminate from this achieves the desired thickness for the guitar neck 1 and the guitar head 3 and before the glue is dried. After pressing and as soon as the glue has dried, the produced laminate can be removed from the press mould and be worked/machined further. In the same manner, a guitar neck with a bent-away head can be manufactured from a laminate of bamboo layers which have been bent prior to this after a pre-treatment in steam. At the end, the fretboard 4 of bamboo is glued on and the tuning mechanism 7 as well as the frets 5 are inserted into the previously milled grooves.

LIST OF REFERENCE NUMERALS

1 neck
2 saddle
3 head
4 fretboard
5 fret or fretrod
6 strings
7 tuning mechanism
8 body
9 potential breakage location along the fibre course
10 potential breakage location on gluing
11 break-resistant nut thanks to the continuous fibre course
12 fibres of the wood workpiece

The invention claimed is:

1. A guitar comprising: a body; a guitar neck, the guitar neck including a fretboard; and a guitar head coupled with the guitar neck; wherein the fretboard of the guitar neck is manufactured completely from horizontally or vertically glued and compacted raw strips of bamboo that are pressed into high-density bamboo grass to form stranded woven bamboo by mixing in phenol-formaldehyde resin of DZT-5 and by pressing the raw strips together into a solid building material, wherein the phenol-formaldehyde resin comprises 40-60% phenol-formaldehyde polymer, up to 0.3% free formaldehyde and up to 1% phenol, and the stranded woven bamboo has as a density greater than natural bamboo, up to 1.25 g/cm$^3$ and a hardness greater than a hardness of natural bamboo, up to 8.61 N/mm$^2$.

2. The guitar according to claim 1, wherein the guitar neck and the guitar head are at least partly manufactured of a single wood piece, by way of the wood piece being bent at the location of a nut located at and end of the fretboard, so that wood fibers of the wood piece run along the guitar neck and run continuously into the guitar head.

3. The guitar according to claim 1, wherein the guitar neck and the guitar head are at least partly manufactured of a continuous laminate of wood, by way of the laminate being bent at a location of a nut located at an end of the fretboard, so that wood fibers of the wood piece run along the guitar neck and run continuously into the guitar head.

4. The guitar according to claim 1, wherein the guitar neck and the guitar head are at least partly manufactured from a single piece of wood which is bent at a location of a nut located at an end of the fretboard, so that wood fibers of the wood piece run along the guitar neck and run continuously into the guitar neck.

5. The guitar according to claim 1, wherein the guitar neck and the guitar head are constructed in a join-free manner partly of several laminated wood layers, by way of bent wood layers being glued together into a laminate, so that wood fibers of the wood piece run along the guitar neck and run continuously into the guitar head.

6. The guitar of claim 1, wherein the guitar neck and the guitar head are constructed completely of several laminated wood layers, by way of bent wood layers being glued together into a laminate, so that wood fibers of the wood piece run along the guitar neck and run continuously into the guitar head.

7. The guitar according to claim 1, wherein the guitar is an electric guitar.

* * * * *